US011131257B2

(12) United States Patent
Chu et al.

(10) Patent No.: US 11,131,257 B2
(45) Date of Patent: Sep. 28, 2021

(54) CONTROL VALVE OF MULTI-SUPERCHARGER SYSTEM

(71) Applicants: Hyundai Motor Company, Seoul (KR); Kia Motors Corporation, Seoul (KR)

(72) Inventors: Dong Ho Chu, Gyeonggi-do (KR); Kwan Hee Lee, Gyeonggi-do (KR); Yeong Seop Park, Seoul (KR); Seung Woo Hong, Seoul (KR); Dong Hee Han, Seoul (KR); Hyun Jin Kang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 52 days.

(21) Appl. No.: 16/686,502

(22) Filed: Nov. 18, 2019

(65) Prior Publication Data

US 2021/0033033 A1 Feb. 4, 2021

(30) Foreign Application Priority Data

Jul. 30, 2019 (KR) ..... 10-2019-0092710

(51) Int. Cl.
*F02D 23/00* (2006.01)
*F02B 33/40* (2006.01)

(52) U.S. Cl.
CPC ..... *F02D 23/00* (2013.01); *F02B 33/40* (2013.01)

(58) Field of Classification Search
CPC ..... F02D 23/00; F02B 33/40; F02B 33/30; F02B 37/013; F16K 11/074; F16K 3/085;
(Continued)

(56) References Cited

U.S. PATENT DOCUMENTS 3,430,651 A * 3/1969 Jackoboice ..... F16K 11/22 137/596
3,595,270 A * 7/1971 McNeal, Jr. ..... F16K 11/202 137/575
(Continued)

FOREIGN PATENT DOCUMENTS

EP 2166211 A1 * 3/2010 ..... F02B 29/0418
FR 2904365 A1 * 2/2008 ..... F02B 37/013
(Continued)

OTHER PUBLICATIONS

An English Machine Translation to Chu Dong Ho (Pub. No. KR 20190014250 A), Published on Feb. 12, 2019. (Year: 2019).*

*Primary Examiner* — Thai Ba Trieu
(74) *Attorney, Agent, or Firm* — Mintz Levin Cohn Ferris Glovsky and Popeo, P.C.; Peter F. Corless

(57) ABSTRACT

A control valve of a multi-supercharger system is provided. The control valve includes a first spool rotatably fitted in a valve body and a second spool fitted in the valve body to be coaxially rotatable together with the first spool. A disk member is installed in the valve body to partition a first chamber, in which the first spool is disposed, and a second chamber, in which the second spool is disposed, from each other. A portion of the disk member includes a communication sector, through which the first chamber and the second chamber communicate with each other. A first inlet and a first outlet are disposed in the valve body and a second inlet and a second outlet are disposed in the valve body. A first valve aperture is formed in the first spool for allowing the first spool to communicate with the communication sector.

10 Claims, 7 Drawing Sheets

(58) Field of Classification Search
CPC .. F16K 11/0716; F16K 27/041; F16K 31/523; F25B 41/062; F25B 41/046; F25B 47/02; B01D 53/0446; F01M 13/011
USPC ..... 60/611, 612, 605.1; 123/562; 137/625.11
See application file for complete search history.

(56) References Cited

U.S. PATENT DOCUMENTS 3,773,076 A * 11/1973 Smith ..... F16K 11/12 137/625.19
4,355,659 A * 10/1982 Kelchner ..... F16K 11/0856 137/625.19
4,669,269 A * 6/1987 Dinger ..... F02B 37/007 60/612
5,174,337 A * 12/1992 Dahlen ..... C02F 1/42 137/625.29
5,338,158 A * 8/1994 Hauge ..... F04F 13/00 417/64
6,688,333 B2 * 2/2004 McLane ..... F16K 11/0856 137/625.11
7,712,312 B2 * 5/2010 Sexton ..... F02D 23/00 60/612
8,635,869 B2 * 1/2014 An ..... F02B 37/013 60/600
2008/0216909 A1 * 9/2008 Kim ..... F16K 11/0743 137/896
2012/0079824 A1 * 4/2012 Son ..... F02D 23/00 60/602
2014/0238358 A1 * 8/2014 Arens ..... F02B 33/30 123/495
2015/0027572 A1 * 1/2015 Morein ..... F16K 41/026 137/625.19
2017/0102092 A1 * 4/2017 Van de Ven ..... F16K 11/07
2018/0328635 A1 * 11/2018 Tashiro ..... F25B 47/02
2019/0126188 A1 * 5/2019 Dolensky ..... B01D 53/0446
2019/0126189 A1 * 5/2019 Dolensky ..... B01D 53/0446
2019/0285322 A1 * 9/2019 Spieth ..... F16K 11/00
2019/0331236 A1 * 10/2019 Singh ..... F16K 3/085
2019/0360601 A1 * 11/2019 Leroyer ..... F16K 11/074
2020/0041011 A1 * 2/2020 Melhus ..... F16K 11/074

FOREIGN PATENT DOCUMENTS

JP 05005419 A * 1/1993 ..... F02B 37/013
KR 10-2019-0014250 A 2/2019
WO WO-2013006914 A1 * 1/2013 ..... F16K 11/074
WO WO-2017094148 A1 * 6/2017 ..... F25B 41/046

* cited by examiner

CONTROL VALVE OF MULTI-SUPERCHARGER SYSTEM

CROSS-REFERENCE TO RELATED APPLICATION

This application claims the priority benefit of Korean Patent Application No. 10-2019-0092710, filed on Jul. 30, 2019 in the Korean Intellectual Property Office, the disclosure of which is incorporated herein by reference.

BACKGROUND

1. Field of the Invention

The present invention relates to an engine system including a plurality of superchargers, and more particularly, to an engine system that controls air flow through the superchargers.

2. Description of the Related Art

Among chargers for increasing the amount of air that is supplied to a combustion chamber of an engine to increase the output of the engine, a supercharger has been developed for charging intake air using driving force of an electric motor. In the supercharger, however, the rotation rate of a rotor of the electric motor and the capacity of the electric motor are limited, and thus, the supercharger is inferior to a turbocharger in the aspect of the pressure ratio of air that is charged and the flow rate of the air.

The matters disclosed in this section are merely for enhancement of understanding of the general background of the invention and should not be taken as an acknowledgment or any form of suggestion that the matters form the related art already known to a person skilled in the art.

SUMMARY

The present invention provides a control valve of a multi-supercharger system configured such that, in an engine system including a plurality of superchargers, it may be possible to adjust the flow of air that passes through the superchargers through a simplified and compact structure to provide various charging modes.

In accordance with the present invention, the above and other objects can be accomplished by the provision of a control valve of a multi-supercharger system that may include a valve body, a first spool rotatably fitted in the valve body, a second spool fitted in the valve body to be coaxially rotatable together with the first spool, a disk member installed in the valve body to partition a first chamber, in which the first spool is disposed, and a second chamber, in which the second spool is disposed, from each other, a portion of the disk member including a communication sector, through which the first chamber and the second chamber communicate with each other, a first inlet and a first outlet disposed in the valve body to switch communication with the interior of the first spool based on rotation of the first spool, a second inlet and a second outlet disposed in the valve body to switch communication with the interior of the second spool based on rotation of the second spool, and a first valve aperture formed in the first spool for allowing the interior of the first spool to communicate with the communication sector when the first spool is rotated in the valve body.

The second spool may include a second valve aperture configured to overlap the opposite side of the communication sector to communicate therewith to allow the interior of the second spool to communicate with the communication sector and the interior of the first spool when the second spool is rotated together with the first spool and thus the first valve aperture overlaps the communication sector to communicate therewith. The surface of the second spool that faces the disk member may be open such that, even when the second spool is rotated in the valve body, the communication sector constantly communicates with the interior of the second spool.

An actuator configured to output rotational force may be fixed to the valve body, a valve shaft may be installed to transmit the rotational force of the actuator to the interior of the valve body, and the valve shaft may sequentially extend through the middle part of the first spool and the middle part of the second spool and may then be fixed thereto. The first inlet and the first outlet of the valve body may be disposed to be spaced apart from each other in the circumferential direction about the valve shaft, and the first spool may have a structure in which four apertures, through which the interior of the first spool communicates with the first inlet and the first outlet, are sequentially disposed in the circumferential direction about the valve shaft.

The second inlet and the second outlet of the valve body may be disposed to be spaced apart from each other in the circumferential direction about the valve shaft, and the second spool may be configured to have a structure in which two apertures, through which the interior of the second spool communicates with the second inlet and the second outlet, are sequentially disposed in the circumferential direction about the valve shaft.

Assuming that the apertures holes of the first spool are aperture A, aperture B, aperture C, and aperture D and that the apertures of the second spool are aperture X and aperture Y, in the state in which the first spool is rotated such that aperture B communicates with the first inlet and aperture C communicates with the first outlet, the second spool may be disposed such that neither aperture X nor aperture Y communicates with the second inlet or the second outlet.

When the first spool is rotated such that aperture D communicates with the first inlet, any one of aperture A, aperture B, and aperture C may not communicate with the first outlet, and the second spool may be disposed such that aperture X communicates with the second outlet and aperture Y does not communicate with the second inlet. When the first spool is rotated such that aperture A communicates first inlet and aperture B communicates first outlet, the second spool may be disposed such that aperture X communicates with the second inlet and aperture Y communicates with the second outlet.

Additionally, when aperture D of the first spool communicates with the first inlet and aperture X of the second spool communicates with the second outlet, the first valve aperture may communicate with the communication sector, and the interior of the second spool may communicate with the interior of the first spool via the communication sector. When a first supercharger and a second supercharger are installed in parallel to move air between an air cleaner and a combustion chamber, the first inlet may be connected to a discharge side of the first supercharger, the first outlet may be connected to the combustion chamber, the second inlet may be connected to the air cleaner, and the second outlet may be connected to an introduction side of the second supercharger.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
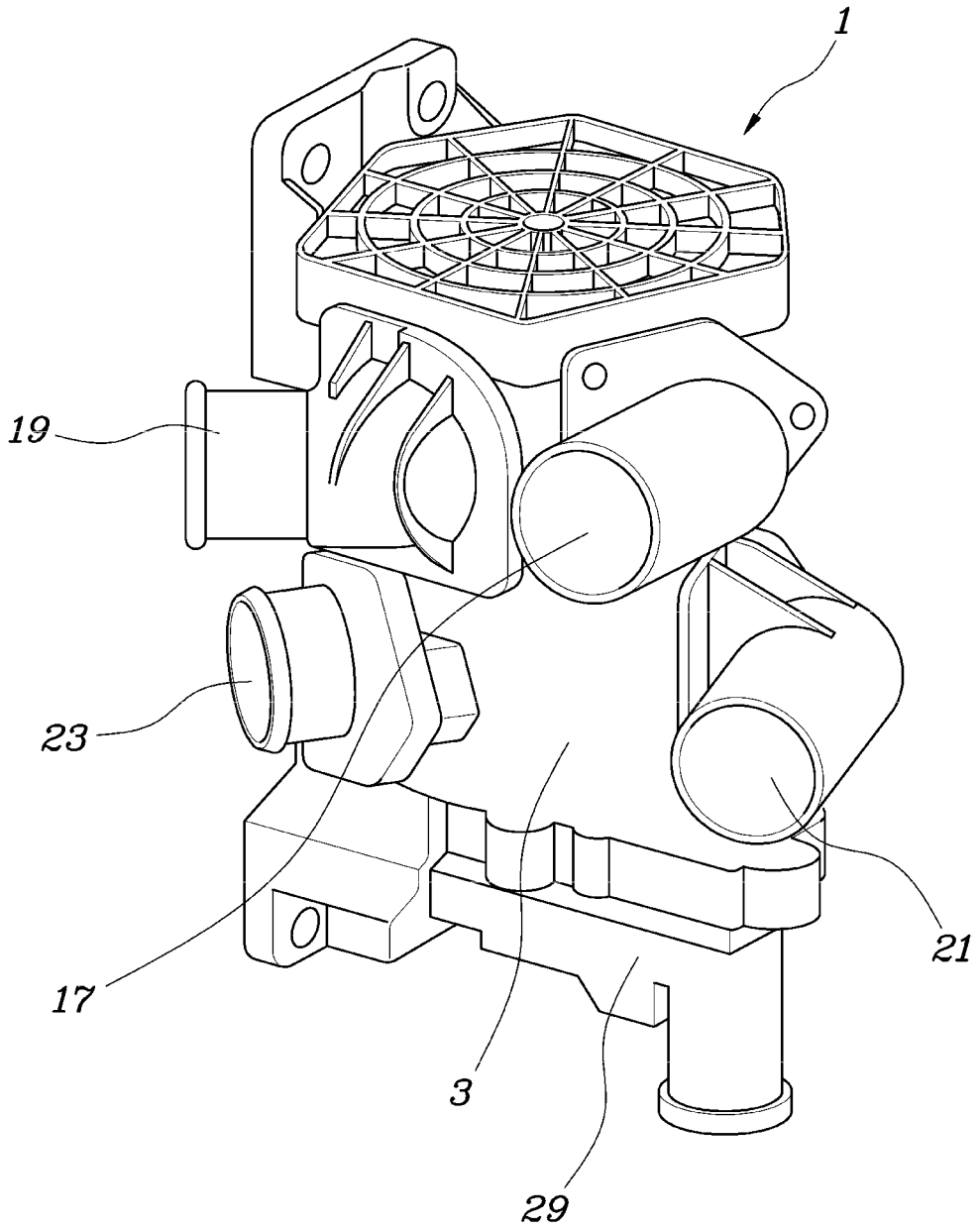
FIG. 1 is a view showing a control valve of a multi-supercharger system according to an exemplary embodiment of the present invention.
Figure 2:
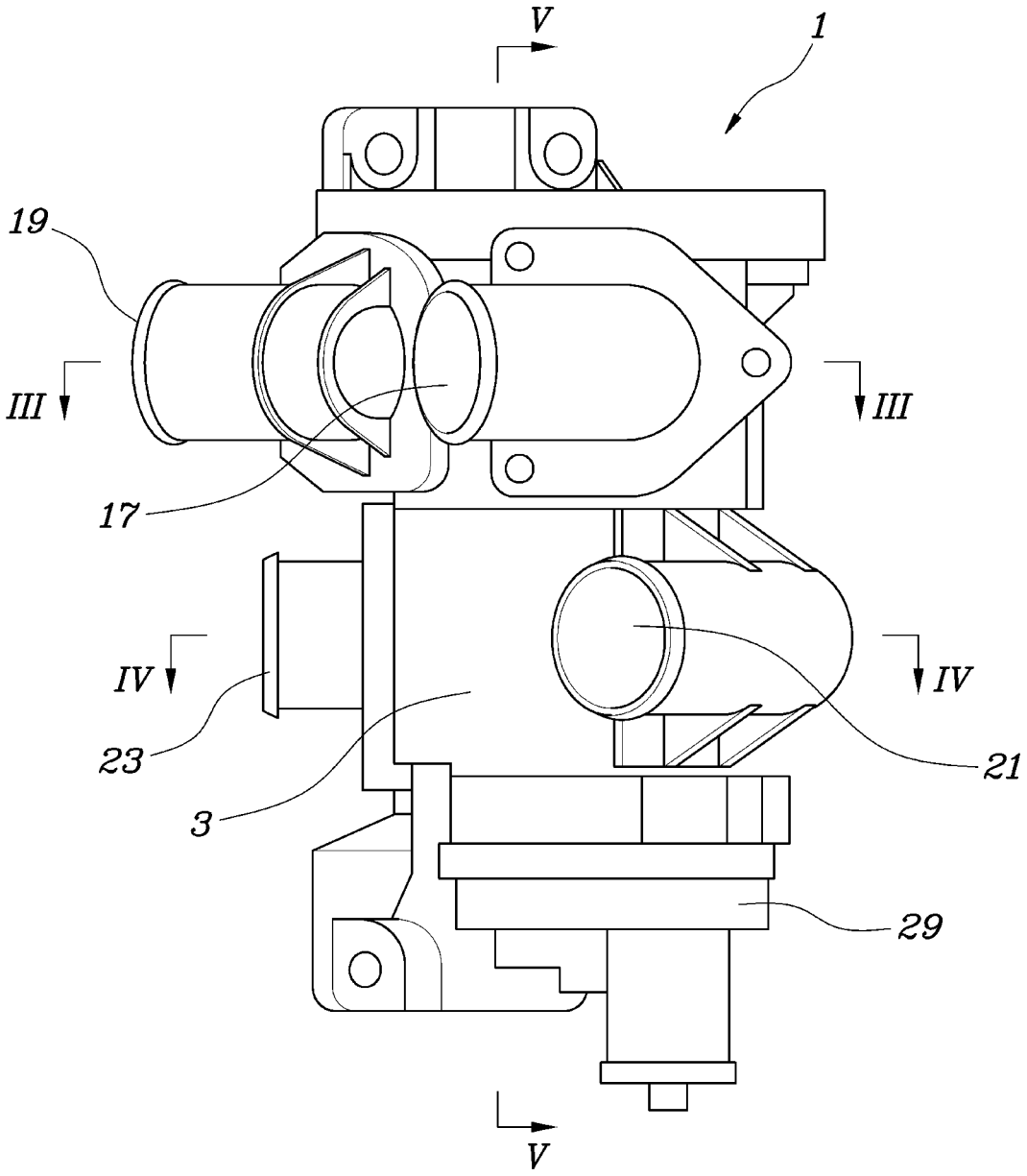
FIG. 2 is a view of the control valve of FIG. 1 when viewed at another angle according to an exemplary embodiment of the present invention.
Figure 3:
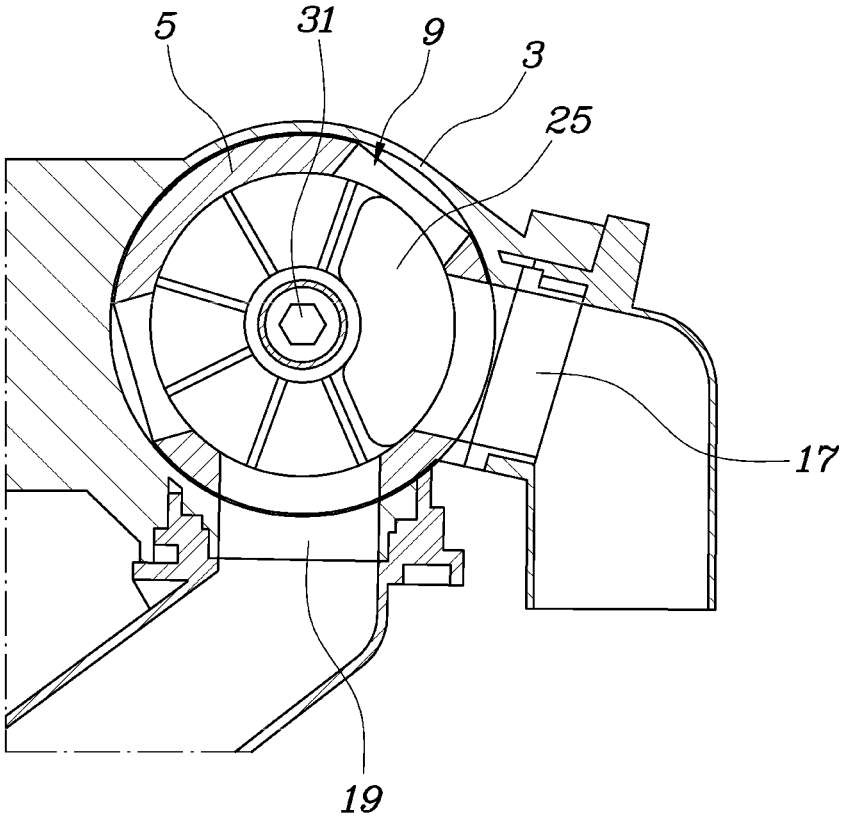
FIG. 3 is a sectional view taken along line of FIG. 2 according to an exemplary embodiment of the present invention.
Figure 4:
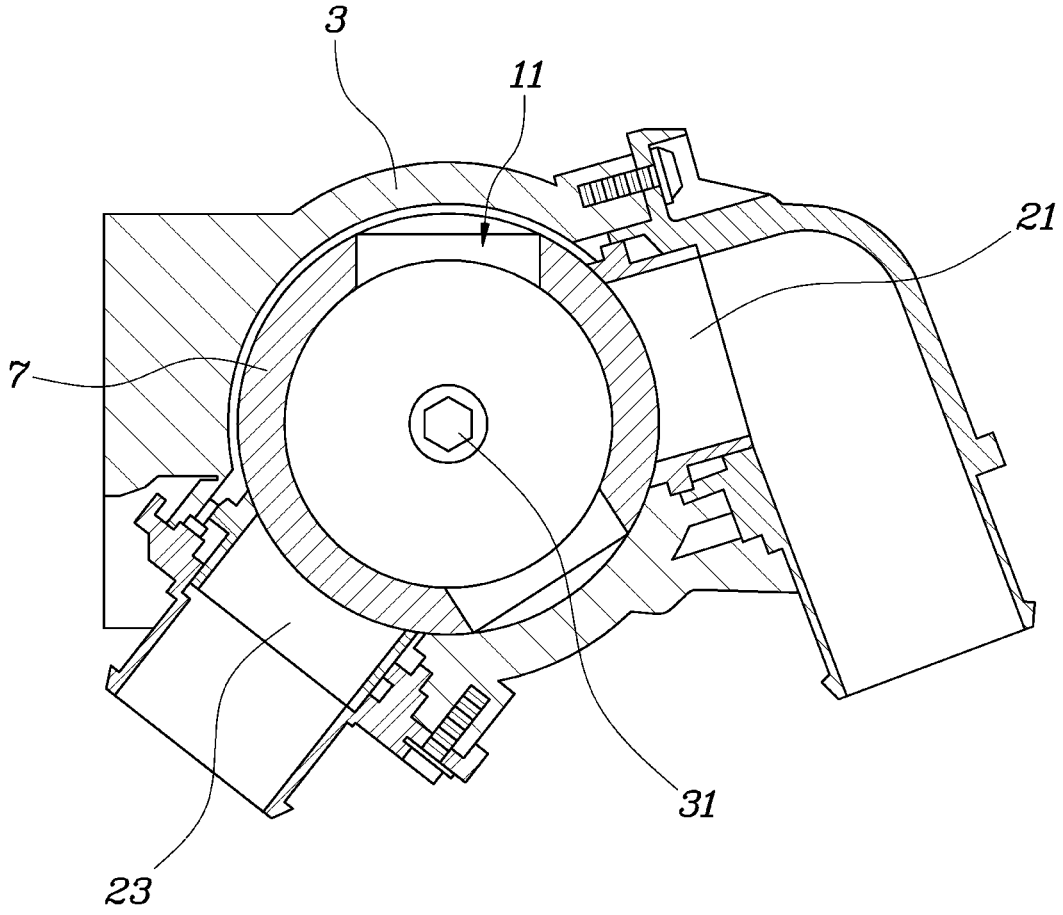
FIG. 4 is a sectional view taken along line IV-IV of FIG. 2 according to an exemplary embodiment of the present invention.
Figure 5:
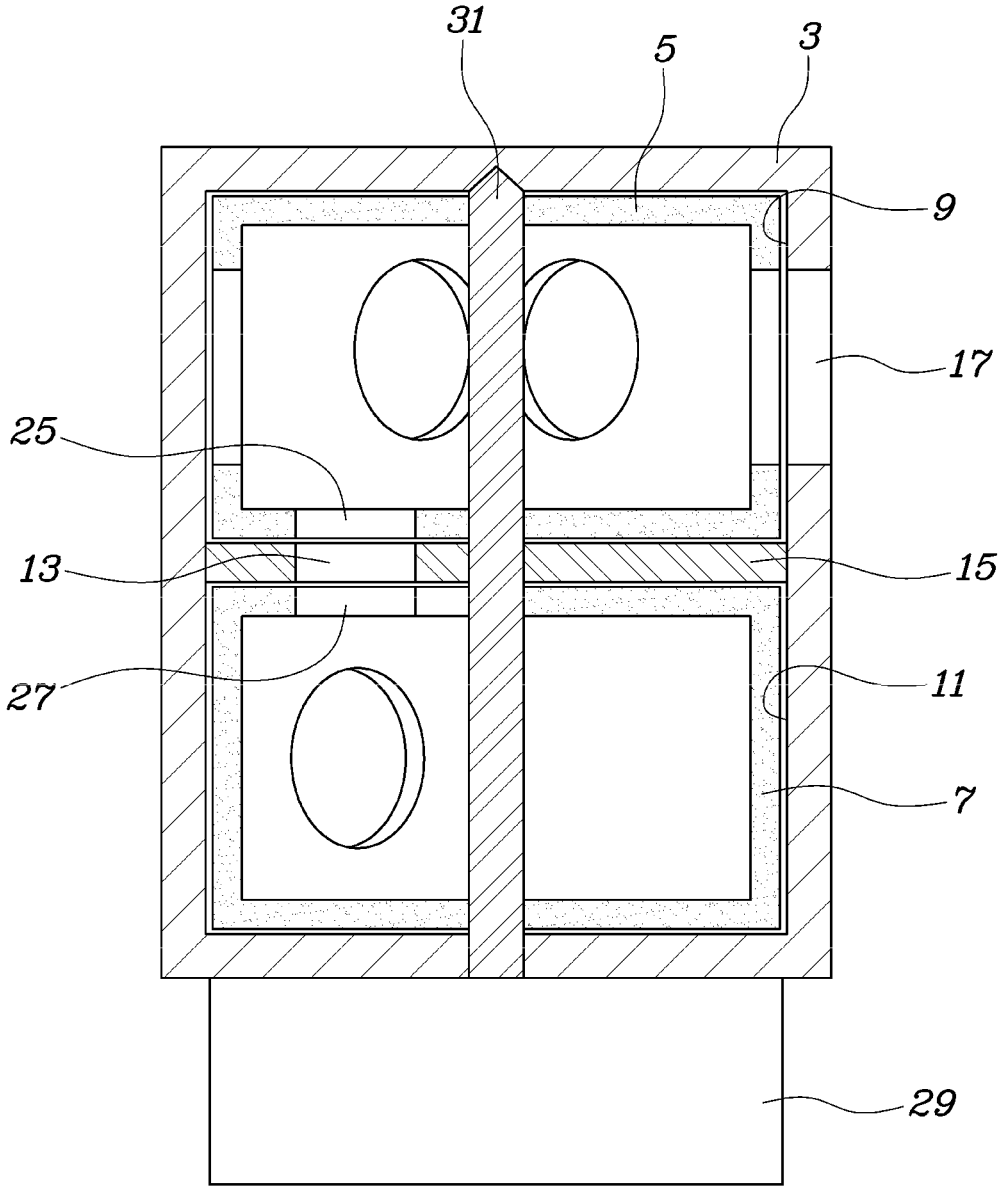
FIG. 5 is a sectional view taken along line V-V of FIG. 2 according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Referring to FIGS. 1 to 7, an exemplary embodiment of a control valve 1 of a multi-supercharger system according to the present invention may include a valve body 3, a first spool 5 rotatably fitted in the valve body 3, a second spool 7 fitted in the valve body 3 to be coaxially rotatable together with the first spool 5, a disk member 15 installed in the valve body 3 to partition a first chamber 9, in which the first spool 5 is disposed, and a second chamber 11, in which the second spool 7 is disposed, from each other, a portion of the disk member 15 including a communication sector 13, through which the first chamber 9 and the second chamber 11 may communicate with each other, a first inlet 17 and a first outlet 19 disposed in the valve body 3 to switch communication with the interior of the first spool 5 according to the rotation of the first spool 5, a second inlet 21 and a second outlet 23 disposed in the valve body 3 to switch communication with the interior of the second spool 7 according to the rotation of the second spool 7, and a first valve aperture 25 formed in the first spool 5 to provide communication between the interior of the first spool 5 and the communication sector 13 when the first spool 5 is rotated in the valve body 3.

The second spool 7 may include a second valve aperture 27, which overlaps the opposite side of the communication sector 13 to communicate therewith and to provide communication for the interior of the second spool 7 with the communication sector 13 and the interior of the first spool 5 when the second spool 7 is rotated together with the first spool 5 and thus the first valve aperture 25 overlaps the communication sector 13 to communicate therewith. Notably, the opposite side of the communication sector refers to a side that is opposite to the side at which the first spool communicates with the communication sector.

In other words, the first spool 5 and the second spool 7 may be rotated together with each other, the state in which the first inlet 17 and the first outlet 19 communicate with the interior of the first spool 5 may be adjusted, the state in which the second inlet 21 and the second outlet 23 communicate with the interior of the second spool 7 may be adjusted, and the interior of the first spool 5 and the interior of the second spool 7 may communicate with each other through the communication sector 13 of the disk member 15 based on the rotational state of the first spool 5 and the second spool 7.

Meanwhile, the surface of the second spool 7 that faces the disk member 15 may be fully open and thus, even when the second spool 7 is rotated in the valve body 3, the communication sector 13 may constantly communicate with the interior of the second spool 7. An actuator 29 configured to output rotational force may be fixed to the valve body 3, a valve shaft 31 may be installed to transmit the rotational force of the actuator 29 to the interior of the valve body 3, and the valve shaft 31 may sequentially extend through the middle part of the first spool 5 and the middle part of the second spool 5 and may be fixed thereto.

When the valve shaft 31 is rotated, therefore, the first spool 5 and the second spool 7 may be rotated together in the valve 3. A controller may be connected to the actuator 29 to operate the actuator 29. When the valve shaft 31 is rotated, the controller may be configured to adjust the rotational angle of each of the first spool 5 and the second spool 7 relative to the valve body 3 to adjust the state in which the first inlet 17 and the first outlet 19 communicate with the interior of the first spool 5 and the state in which the second inlet 21 and the second outlet 23 communicate with the interior of the second spool 7.

The first inlet 17 and the first outlet 19 of the valve body 3 may be disposed spaced apart from each other in the circumferential direction about the valve shaft 31, and the first spool 5 may have a structure in which four apertures, through which the interior of the first spool 5 communicates with the first inlet 17 and the first outlet 19, are sequentially disposed in the circumferential direction about the valve shaft 31. The second inlet 21 and the second outlet 23 of the valve body 3 may be disposed to be spaced apart from each other in the circumferential direction about the valve shaft 31, and the second spool 7 may have a structure in which two apertures, through which the interior of the second spool 7 communicates with the second inlet 21 and the second outlet 23, are sequentially disposed in the circumferential direction about the valve shaft 31.

Figure 6:
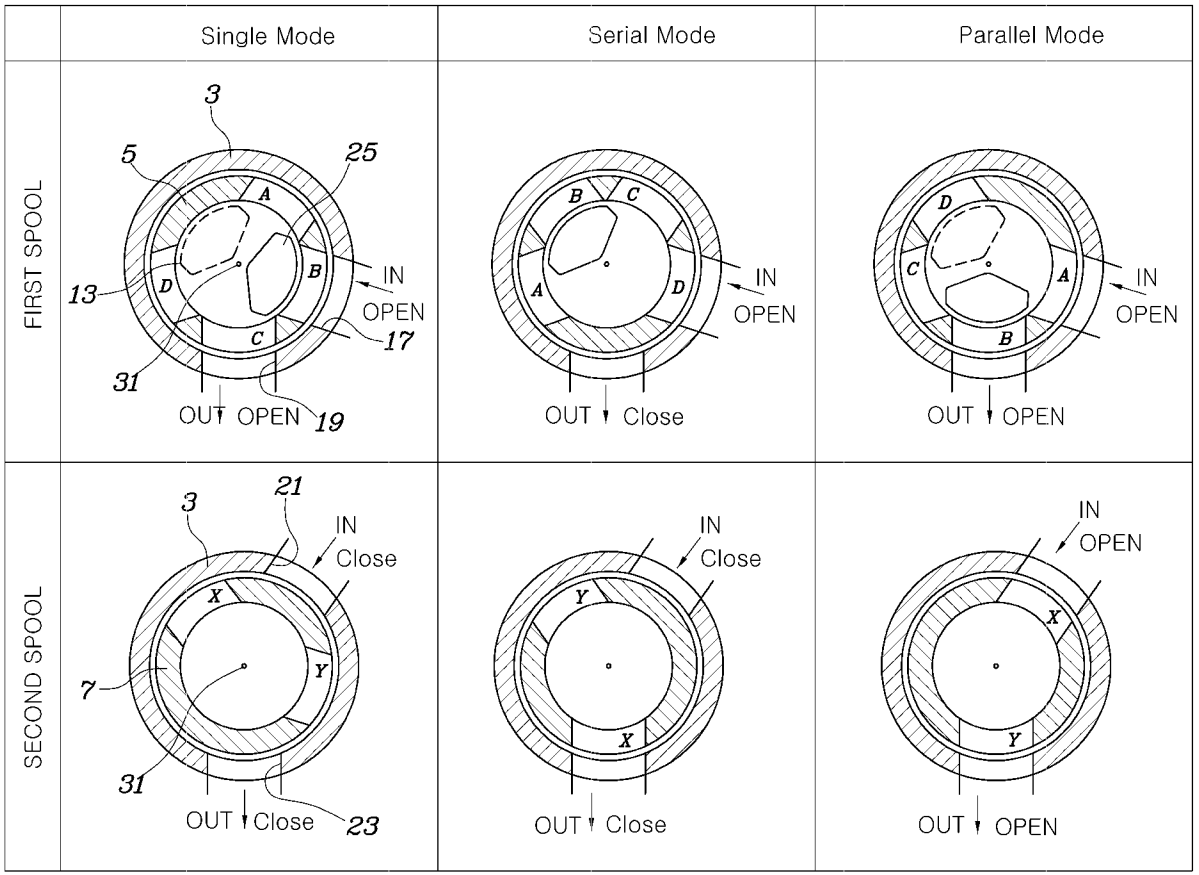
FIG. 6 is a view showing switching between charging modes based on the rotation of a first spool and a second spool according to an exemplary embodiment of the present invention.

Referring to FIG. 6, based on the assumption that the four apertures of the first spool 5 are aperture A, aperture B, aperture C, and aperture D and that the apertures of the second spool 7 are aperture X and aperture Y, in the state in which the first spool 5 is rotated such that aperture B communicates with the first inlet 17 and aperture C communicates with the first outlet 19, the second spool 7 may be disposed such that neither aperture X nor aperture Y communicates with the second inlet 21 or the second outlet 23, which constitutes a single mode.

When the first spool 5 is rotated such that aperture D communicates with the first inlet 17, any one of aperture A, aperture B, and aperture C does not communicate with the first outlet 19 (e.g., the communication is blocked), and the second spool 7 may be disposed such that aperture X communicates with the second outlet 23 and aperture Y does not communicate with the second inlet 21 (e.g., the communication is prevented or blocked), which constitutes a serial mode. At this time, the first valve aperture 25 may communicate with the communication sector 13, and the interior of the second spool 7 may communicate with the interior of the first spool 5 via the communication sector 13.

Consequently, air introduced through the first inlet 17 having a flow channel in which the air passes through aperture D of the first spool 5, may sequentially pass through the first valve aperture 25, the communication sector 13, and the second valve aperture 27, and then may be discharged through the second outlet 23 via aperture X of the second spool 7. Additionally, when the first spool 5 is rotated such that aperture A communicates first inlet 17 and aperture B communicates first outlet 19, the second spool 7 may be disposed such that aperture X communicates with the second inlet 21 and aperture Y communicates with the second outlet 23, which constitutes a parallel mode.

Figure 7:
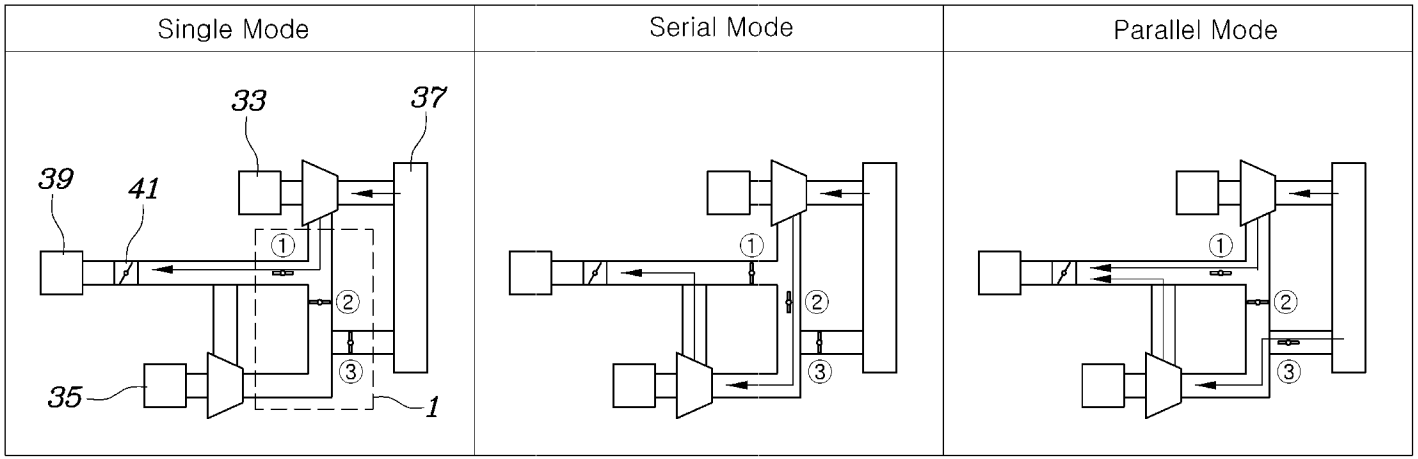
FIG. 7 is a view illustrating that the charging modes shown in FIG. 6 are realized in an engine system including two superchargers according to an exemplary embodiment of the present invention.

Referring to FIG. 7, a first supercharger 33 and a second supercharger 35 may be installed in parallel to move air between an air cleaner 37 and a combustion chamber 39. For reference, reference numeral 41 indicates a throttle valve. When the control valve 1 according to the present invention described above is applied to the structure of FIG. 7, the first inlet 17 may be connected to the discharge side of the first supercharger 33, the first outlet 19 may be connected to the combustion chamber 39, the second inlet 21 may be connected to the air cleaner 37, and the second outlet 23 may be connected to the introduction side of the second supercharger 35.

For reference, switching of the state in which the first inlet 17 and the first outlet 19 communicate with the first spool 5 is expressed as switching of a valve indicated by ① of FIG. 7, switching of the state in which the second inlet 21 and the second outlet 23 communicate with the second spool 7 is expressed as switching of a valve indicated by ③ of FIG. 7. Additionally, opening or closing of the first valve aperture 25 of the first spool 5 and the second valve aperture 27 of the second spool 7 due to overlapping or deviation from the communication sector 13 is expressed as switching of a valve indicated by ② of FIG. 7.

In the single mode of FIG. 7, air suctioned through the air cleaner 37 may be compressed by the first supercharger 33, and then may be supplied to the combustion chamber 39 via aperture B and aperture C of the first spool 5. In the serial mode, the air compressed by the first supercharger 33 may be introduced into aperture D of the first spool 5, may be discharged through aperture X of the second spool 7 via the first valve aperture 25, the communication sector 13, and the second valve aperture 27, may be further compressed by the second supercharger 35, and may be supplied into the combustion chamber 39.

Further, in the parallel mode, the air compressed by the first supercharger 33 may be supplied into the combustion chamber 39 via aperture A and aperture B of the first spool 5, and the second supercharger 35 may be configured to suction air from the air cleaner 37 through aperture X and aperture Y of the second spool 7, compress the air, and supply the compressed air into the combustion chamber 39. At this time, the communication sector 13 may be blocked, and thus, the air compressed by the first supercharger 33 and the air compressed by the second supercharger 35 may be supplied into the combustion chamber 39 in parallel.

As described above, the control valve 1 according to the present invention may switch between the three charging modes, such as the single mode, the serial mode, and the parallel mode, by rotation of a single actuator 29. In addition, the structure of the control valve is simplified and compact and thus, it may be possible to easily the control valve more easily in an engine room.

As is apparent from the above description, in an engine system including a plurality of superchargers, it may be possible to adjust the flow of air that passes through the superchargers through a simplified and compact structure to thus provide various charging modes. Particularly, in an engine system including two superchargers, it may be possible to more easily perform switching between a single mode, in which only one of the two superchargers is operated, a serial mode, in which air is sequentially compressed by the two superchargers, and a parallel mode, in which the two superchargers compress air and supply the compressed air to a combustion chamber, using a single actuator.

Although the exemplary embodiments of the present invention have been described above with reference to the accompanying drawings, those skilled in the art will appreciate that the present invention may be implemented in various other exemplary embodiments without changing the technical ideas or features thereof

What is claimed is:

1. A control valve of a multi-supercharger system, comprising:

a valve body;

a first spool rotatably fitted in the valve body;

a second spool fitted in the valve body to be coaxially rotatable together with the first spool;

a disk member installed in the valve body to partition a first chamber, in which the first spool is disposed, and a second chamber, in which the second spool is disposed, from each other, wherein a portion of the disk member includes a communication sector, through which the first chamber and the second chamber communicate with each other;

a first inlet and a first outlet disposed in the valve body to switch communication with an interior of the first spool according to rotation of the first spool;

a second inlet and a second outlet disposed in the valve body to switch communication with an interior of the second spool according to rotation of the second spool;

a first valve aperture formed in the first spool to provide communication between the interior of the first spool and the communication sector when the first spool is rotated in the valve body;

a single actuator configured to output rotational force and fixed to the valve body; and a valve shaft installed to the single actuator to transmit the rotational force of the single actuator to the interior of the valve body, wherein the valve shaft sequentially extends through a middle part of the first spool and a middle part of the second spool and is fixed thereto.

2. The control valve according to claim 1, wherein the second spool includes a second valve aperture that overlaps an opposite side of the communication sector to communicate therewith to allow the interior of the second spool to communicate with the communication sector and the interior of the first spool when the second spool is rotated together with the first spool and the first valve aperture overlaps the communication sector to communicate therewith.

3. The control valve according to claim 1, wherein a surface of the second spool that faces the disk member is open and when the second spool is rotated in the valve body, the communication sector constantly communicates with the interior of the second spool.

4. The control valve according to claim 1, wherein:

the first inlet and the first outlet of the valve body are disposed to be spaced apart from each other in a circumferential direction about the valve shaft, and the first spool includes four apertures, through which the interior of the first spool communicates with the first inlet and the first outlet, wherein the four apertures are sequentially disposed in the circumferential direction about the valve shaft.

5. The control valve according to claim 4, wherein:

the second inlet and the second outlet of the valve body are disposed to be spaced apart from each other in the circumferential direction about the valve shaft, and the second spool includes two apertures, through which the interior of the second spool communicates with the second inlet and the second outlet, wherein the two apertures are sequentially disposed in the circumferential direction about the valve shaft.

6. The control valve according to claim 5, wherein:

the four apertures of the first spool include aperture A, aperture B, aperture C, and aperture D and that the two apertures of the second spool include aperture X and aperture Y, and when the first spool is rotated such that aperture B communicates with the first inlet and aperture C communicates with the first outlet, the second spool is disposed to block communication of aperture X and aperture Y with the second inlet and the second outlet.

7. The control valve according to claim 6, wherein, when the first spool is rotated such that aperture D communicates with the first inlet, communication of aperture A, aperture B, and aperture C with the first outlet is blocked, and the second spool is disposed such that aperture X communicates with the second outlet and communication between aperture Y and the second inlet is blocked.

8. The control valve according to claim 7, wherein, when the first spool is rotated such that aperture A communicates first inlet and aperture B communicates first outlet, the second spool is disposed such that aperture X communicates with the second inlet and aperture Y communicates with the second outlet.

9. The control valve according to claim 8, wherein, when aperture D of the first spool communicates with the first inlet and aperture X of the second spool communicates with the second outlet, the first valve aperture communicates with the communication sector, and the interior of the second spool communicates with the interior of the first spool via the communication sector.

10. The control valve according to claim 1, wherein the multi-supercharger system further comprises a first supercharger and a second supercharger, when the first supercharger and the second supercharger are installed in parallel to move air between an air cleaner and a combustion chamber, the first inlet is connected to a discharge side of the first supercharger, the first outlet is connected to the combustion chamber, the second inlet is connected to the aft cleaner, and the second outlet is connected to an introduction side of the second supercharger.

* * * * *